US006014535A

United States Patent [19]

Zenk et al.

[11] Patent Number: 6,014,535

[45] Date of Patent: Jan. 11, 2000

[54] SOFT CARTRIDGE PACKAGE FOR A PHOTORECEPTOR BELT AND METHOD OF MANUFACTURING SOFT CARTRIDGE PACKAGE INCLUDING METHOD OF LOADING PHOTORECEPTOR BELT USING SOFT CARTRIDGE PACKAGE

[75] Inventors: James E. Zenk, St. Paul; Randy A. Bierwerth, Oakdale; John D. Watson, Centerville; Bruce W. Carlson, Minneapolis; Brett R. Johnson, St. Paul, all of Minn.

[73] Assignee: Imation Corp., Oakdale, Minn.

[21] Appl. No.: 09/209,189

[22] Filed: Dec. 10, 1998

[51] Int. Cl.[7] ..... G03G 15/00; G03G 21/00

[52] U.S. Cl. ..... 399/116; 399/162

[58] Field of Search ..... 399/116, 162

[56] References Cited

U.S. PATENT DOCUMENTS

| | | | |
|---|---|---|---|
| 3,877,806 | 4/1975 | Schrempp et al. | 355/16 |
| 3,888,577 | 6/1975 | Meyer | 355/3 R |
| 4,009,958 | 3/1977 | Kurita et al. | 355/16 |
| 4,319,829 | 3/1982 | Janeway, III et al. | 355/3 BE |
| 4,544,260 | 10/1985 | Kolbe | 355/3 BE |
| 4,766,455 | 8/1988 | Carter | 355/3 BE |
| 4,811,839 | 3/1989 | Cornell et al. | 206/303 |
| 5,065,195 | 11/1991 | Haneda et al. | 355/298 |
| 5,119,133 | 6/1992 | Swain | 355/212 |
| 5,400,121 | 3/1995 | Foote | 355/212 |
| 5,417,322 | 5/1995 | Jeran et al. | 206/303 |
| 5,708,923 | 1/1998 | Duval et al. | 399/116 |
| 5,708,924 | 1/1998 | Shogren et al. | 399/116 |
| 5,809,375 | 9/1998 | Owens, Jr. et al. | 399/111 |

FOREIGN PATENT DOCUMENTS

| | | | |
|---|---|---|---|
| 0 871 079 A1 | 10/1998 | European Pat. Off. | G03G 15/00 |
| 0 892 313 | 1/1999 | European Pat. Off. . | |

*Primary Examiner*—Fred L. Braun
*Attorney, Agent, or Firm*—William D. Bauer

[57] ABSTRACT

A cartridge device for packaging an endless, organic photoreceptor belt of an electrophotographic printer. The cartridge device is a closed loop support structure manufactured of a resilient material around which the endless belt extends. The resilient support structure has a belt loading configuration, that substantially duplicates the configuration of the endless belt when the belt is mounted onto support rollers of the electrophotographic printer. By replicating the configuration of the support rollers, loading of the belt onto the rollers is facilitated using the cartridge device. The resilient support structure also has a compact configuration that requires less volume than the belt loading configuration. The compact configuration of the cartridge device minimizes shipping volume and storage space requirements for replacement photoreceptor belts. In both the belt loading configuration and the compact configuration, the cartridge device substantially protects the photoreceptor belt from inadvertent damage that would adversely affect the image reproduction quality of the replacement belt.

21 Claims, 11 Drawing Sheets

SOFT CARTRIDGE PACKAGE FOR A PHOTORECEPTOR BELT AND METHOD OF MANUFACTURING SOFT CARTRIDGE PACKAGE INCLUDING METHOD OF LOADING PHOTORECEPTOR BELT USING SOFT CARTRIDGE PACKAGE

TECHNICAL FIELD

This invention relates to electrophotographic printers that employ organic photoreceptor belts. In particular, the present invention is a soft cartridge package and a method of manufacture of a soft cartridge package that allows a user to load a new organic photoreceptor belt into an electrophotographic printer without damaging or otherwise adversely affecting the image producing quality of the new belt.

CROSS REFERENCE TO RELATED APPLICATIONS

This patent is related to U.S. patent application Ser. No. 09/209298, entitled "Protective Cover Package for an Organic Photoreceptor Belt" filed herewith on Dec. 10, 1998 and assigned to the same assignee and having Attorney Docket No. 53827USA9A; and to U.S. patent application Ser. No. 09/208971, entitled "Hard Cartridge Package for an Organic Photoreceptor Belt" also filed herewith on Dec. 10, 1998 and also assigned to the same assignee and having Attorney Docket No. 53841US01.

BACKGROUND OF THE INVENTION

Throughout the business world, electrophotographic printers are extensively used for image reproduction. To effect image reproduction, one type of electrophotographic printer employs a belt having an organic photoreceptor coating thereon. As a result of various wear factors, the life span of the organic photoreceptor coating on the belt is less than the life span of the electrophotographic printer, thereby requiring that the organic photoreceptor coated belt be periodically replaced. The life span of the organic photoreceptor belt is limited because the organic photoreceptor coating layers deteriorate over time as a result of continued exposures to the imaging process. Consequently, the characteristics of the organic photoreceptor belt change and thereby adversely affect the quality of the reproduced image. In addition, the organic photoreceptor coating of the belt may include a release layer which tends to change its surface properties over time. The surface property changes of this release layer adversely affects the image quality of subsequent reproductions.

Within the business environment, the task of periodically replacing the organic photoreceptor coated belt is typically accomplished by office personnel instead of electrophotographic printer service technicians. To allow office personnel to perform the task of organic photoreceptor belt replacement, the organic photoreceptor belt can be packaged with other consumables within a rigid cartridge. Typically, the process of used organic photoreceptor belt replacement is accomplished by completely exchanging the old cartridge containing the used organic photoreceptor belt for a new cartridge containing an unused organic photoreceptor belt. By packaging the organic photoreceptor belt within a cartridge, organic photoreceptor belt replacement is more easily performed by office personnel. In addition, the cartridge also protects the fragile organic photoreceptor coating of the belt from damage that can easily occur during the organic photoreceptor belt replacement process.

The cartridge provides a way to change out the belt without directly contacting the belt surface. The process of used organic photoreceptor belt replacement is accomplished by completely exchanging the old cartridge containing the used organic photoreceptor belt (and other consumables) for a new cartridge containing an unused organic photoreceptor belt (and other consumables). Although it may not be necessary to replace the other consumables contained within the cartridge since they may have a longer life than the belt (such as the belt rollers, etc.), the entire cartridge is replaced.

Although the above described typical, organic photoreceptor belt replacement cartridge design facilitates belt replacement and protects the organic photoreceptor coated belt from inadvertent damage, there are some disadvantages to this design. For example, since organic photoreceptor belt replacement also requires that an old cartridge be replaced with a new cartridge, the process of belt replacement creates a significant amount of consumables that must be disposed of. Not only is the used organic photoreceptor belt thrown away but the typical cartridge design necessitates that the used belt cartridge be disposed of with the used belt. All of the consumables within the cartridge are replaced, even though the organic photoreceptor belt may be the only item requiring replacement. This is of particular concern today with the ever increasing emphasis on decreasing office environment consumables. Moreover, because of the rigid design of the typical organic photoreceptor belt cartridge, there is the added concern of dealing with a bulky item in the trash. The rigid, bulky nature of the typical organic photoreceptor belt cartridge design creates other disadvantages as well. For example, a rigid cartridge packaged organic photoreceptor belt can require substantial supply shelf space within an office. In addition, a bulky, rigid organic photoreceptor belt cartridge can require considerable shipping container volume which translates into higher shipping costs. Moreover, the weight of a rigid organic photoreceptor belt cartridge further increases shipping costs. Lastly, the design of a rigid organic photoreceptor belt cartridge typically requires intricately shaped parts to accommodate the organic photoreceptor belt support roller configuration of the electrophotographic printer. This increases manufacturing costs and thereby the consumer cost of replacement organic photoreceptor belts.

There is a need for an improved cartridge for packaging replacement organic photoreceptor belts and for an improved method of organic photoreceptor belt cartridge manufacture. In particular, there is a need for cartridge package that not only facilitates organic photoreceptor belt replacement and protects the replacement organic photoreceptor coated belt from inadvertent damage during the replacement process, but minimizes the amount of consumables that must be disposed of as a result of organic photoreceptor belt replacement. In addition, the cartridge package configuration, for the replacement organic photoreceptor belt, should be of minimal shipping volume and weight, so as to minimize shipping costs and office supply shelf space requirements. Moreover, the organic photoreceptor belt cartridge should provide these features while being relatively easy and inexpensive to manufacture.

SUMMARY OF THE INVENTION

The present invention is a cartridge device for packaging an endless organic photoreceptor belt of an image forming apparatus, such as an electrophotographic printer. The present invention is a soft cartridge package and a method of manufacture of a soft cartridge package that allows a user to load an organic photoreceptor belt into an electrophotographic printer without damaging or otherwise adversely affecting the image producing quality of the belt.

In one embodiment, the present invention provides a cartridge device for packaging an endless photoreceptor belt of an image forming apparatus having support rollers for supporting the endless photoreceptor belt. The cartridge device includes a structure for supporting the endless photoreceptor belt. The support structure includes a belt loading configuration, that substantially duplicates a configuration of the endless belt when the belt is mounted onto the support rollers of the image forming apparatus, so as to facilitate loading of the belt onto the support rollers. The support structure includes a compact configuration, that requires less volume than the belt loading configuration.

In one aspect, the support structure is formed of a resilient material, wherein the resiliency of the material allows the support structure with the photoreceptor belt supported thereon to move between its lesser volume compact configuration and its greater volume belt loading configuration. One of the compact configuration and the belt loading configuration is a normal memory set state of the support structure and the other one of the compact configuration and a belt loading configuration is held in that configuration by an outer force. In one application, the normal memory set state of the support structure is the belt loading configuration. The lesser volume compact configuration of the support structure with the photoreceptor belt supported thereon facilitates storage and shipping of the belt. The outer force that maintains the support structure in its compact configuration is provided by a closed container that houses the support structure during shipping and storage.

The support structure has a closed loop shape and engages an inner surface of the endless photoreceptor belt to support the belt under tension. The support structure is defined by a planar sheet of resilient material having first and second marginal edges that are joined to form the closed loop shaped support structure. The first and second marginal edges are joined via an interleaved lap join held together by adhesive. In one aspect, the endless photoreceptor belt is loaded onto the support rollers of the image forming apparatus by inserting the closed loop support structure with the belt supported thereon over the support rollers, and wherein the support structure defining the cartridge device includes removal mechanism to permit photoreceptor belt holddown mechanism, of the image forming apparatus, to hold the belt against movement relative to the support rollers, so that the closed loop support structure can be removed from the support rollers and the belt, leaving only the belt on the support rollers of the image forming apparatus.

The removal mechanism of the closed loop support structure is defined by a plurality of cutout regions that allow the photoreceptor belt hold down mechanism to hold the photoreceptor belt to the support rollers though the cutout regions. The plurality of cutout regions includes a pair of cutouts oppositely positioned along a side edge of the closed loop support structure. The cartridge device may further include mechanism on the support structure to allow a user to grip the support structure to facilitate the removal of the closed loop support structure from the support rollers and from underneath the photoreceptor belt. In one application, the grip mechanism includes a pair of oppositely positioned handles that extend outwardly from a side edge of the closed loop support structure.

In one aspect, the first and second marginal edges of the closed loop support structure are joined via a releasable adhesive. The endless photoreceptor belt is loaded onto the support rollers of the image forming apparatus by inserting the closed loop support structure with the belt supported thereon over the support rollers. In one application the first marginal edge of the support structure defining the cartridge includes a flap to permit cartridge device removal mechanism, of the image forming apparatus, to grasp the flap and cause separation of the first and second marginal edges of the support structure along the releasable adhesive, so that the closed loop support structure can be removed from the support rollers and the belt, leaving only the belt on the support rollers of the image forming apparatus.

In another embodiment, the present invention provides a method of manufacturing a closed loop cartridge device for packaging an endless photoreceptor belt of an image forming apparatus having support rollers for supporting the endless photoreceptor belt. The method includes the step of providing a sheet of resilient material having first and second marginal edges and first and second side edges. A tubular shaped, closed loop structure is formed from the sheet of resilient material. A form is provided which has a configuration that substantially duplicates a configuration of the endless photoreceptor belt when the endless photoreceptor belt is mounted onto the support rollers of the image forming apparatus. The tubular shaped, closed loop structure is positioned over the form. The closed loop structure on the form is heated for a set amount of time, such that the closed loop structure defines a formed closed loop cartridge device. The shape of the closed loop cartridge device substantially replicates the configuration of the form, and thereby duplicates the configuration of an endless photoreceptor belt when the endless photoreceptor belt is mounted onto the support rollers of an image forming apparatus. The formed closed loop cartridge device is removed from the form.

An endless photoreceptor belt is positioned on an outer surface of the closed loop cartridge device. The step of forming the tubular shaped, closed loop support structure includes the step of removing material from the first side edge of the sheet of resilient material to form a pair of oppositely positioned cutouts. Material is removed from the second side edge of the sheet of resilient material to form a pair of oppositely positioned handles. The first marginal edge of the support structure is joined to the second marginal edge of the support structure thereby defining the tubular shaped closed loop structure. In one aspect, the step of applying heat to the closed loop support structure on the form includes the step of cooling the closed loop cartridge device to room temperature.

In another embodiment, the present invention provides a method of loading an endless photoreceptor belt onto support rollers of an image forming apparatus. The method includes the step of providing a cartridge device defined by a closed loop support structure having an endless photoreceptor belt thereround. The support structure with the belt thereon has a configuration that substantially duplicates a configuration of support rollers of an image forming apparatus. The closed loop support structure is aligned with the support rollers of the image forming apparatus such that the configuration of the support structure matches the configuration of the support rollers. The closed loop support structure is moved onto the support roller such that the support structure, with the endless photoreceptor belts supported thereon, is fully on the support rollers. The closed loop support structure is removed from between the endless photoreceptor belt and the support rollers leaving only the belt on the support rollers of the image forming apparatus. The endless photoreceptor belt is tensioned to make the belt ready for image reproduction.

The step of removing the closed loop support structure from between the endless photoreceptor belt and the support rollers may include the step of holding the belt against movement relative to the support rollers using a photoreceptor belt hold down mechanism of the image forming apparatus, so that the support structure, defining the cartridge device, can be removed from the support rollers without the altering the position of the belt. Grip mechanism on the support structure are grasped to facilitate removal of the support structure between the belt and the support rollers. The step of removing the closed loop support structure from between the endless photoreceptor belt and the support rollers includes the step of actuating cartridge device removal mechanism of the image forming apparatus which is engaged within a removal flap on the support structure and causes the support structure to separate along its marginal edges and removes the support structure, defining the cartridge device, from the support rollers without altering the position of the belt. The support structure is removed from the cartridge device removal mechanism.

The cartridge device of the present invention, whether in the belt loading configuration or the compact configuration, holds the organic photoreceptor belt in a tensioned state that helps to protect the belt from damaging bends and creases that would adversely affect the image reproduction quality of the replacement organic photoreceptor belt. In addition, the cartridge device protects the fragile organic photoreceptor coating of the belt from other damage, in the form of finger prints, scratches and/or abrasions, caused by organic photoreceptor belt mishandling by office personnel during the replacement process. The cartridge device provides protection during the organic photoreceptor belt replacement process since office personnel need only touch the cartridge device during the replacement process and not the organic photoreceptor belt itself. In addition to providing organic photoreceptor belt protection, the cartridge device of the present invention minimizes, when compared to prior art cartridge designs, the amount of consumables that must be disposed of as a result of the organic photoreceptor belt replacement process. Moreover, the cartridge device of the present invention in its compact configuration facilitates storage and shipping of replacement organic photoreceptor belts since the compact configuration requires less volume than the belt loading configuration. By minimizing the shipping volume and weight of the organic photoreceptor belt replacement, the cartridge device of the present invention also minimizes shipping costs and office supply shelf space requirements. Lastly, this organic photoreceptor belt cartridge device also provides these features while being relatively easy and inexpensive to manufacture.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
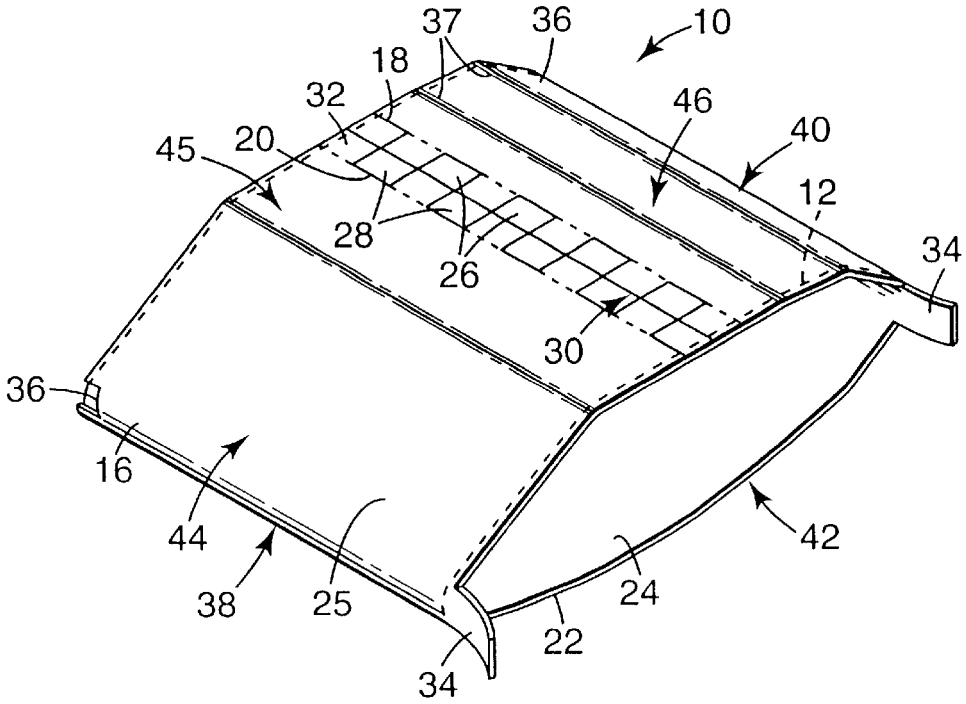
FIG. 1 is a perspective view illustrating a belt loading configuration of a cartridge device for packaging replacement, endless, organic photoreceptor (OPR) belts for an electrophotographic printer (EP) in accordance with the present invention.
Figure 2:
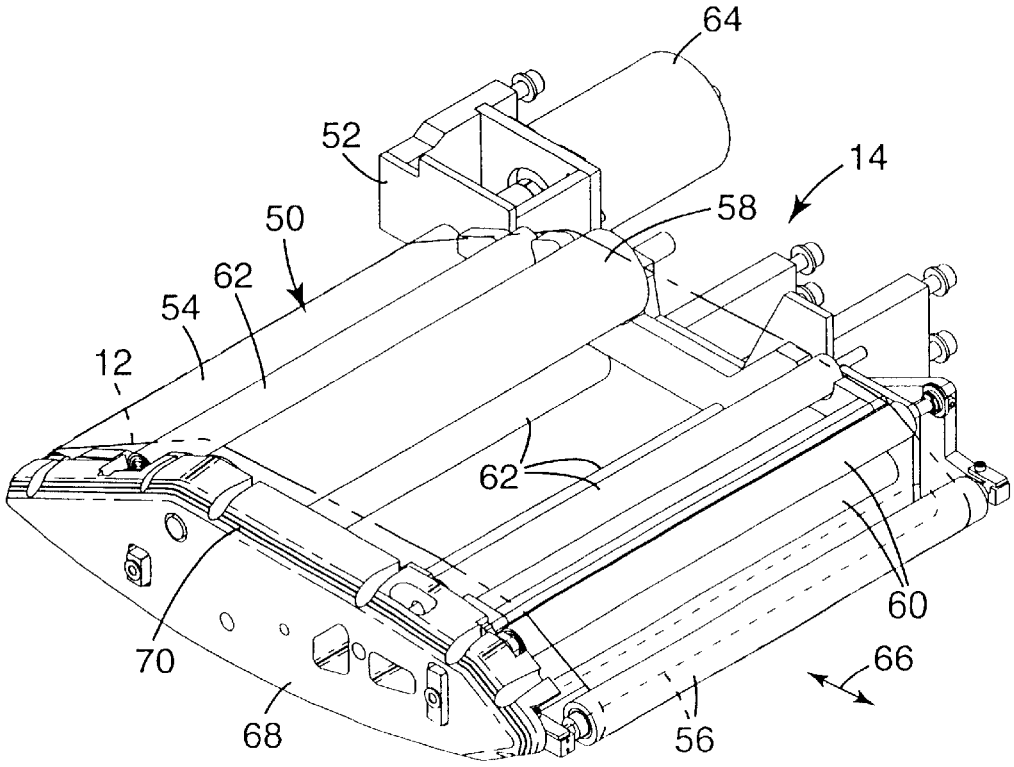
FIG. 2 is a perspective view of a support roller system for the organic photoreceptor belt of the electrophotographic printer.
Figure 3:
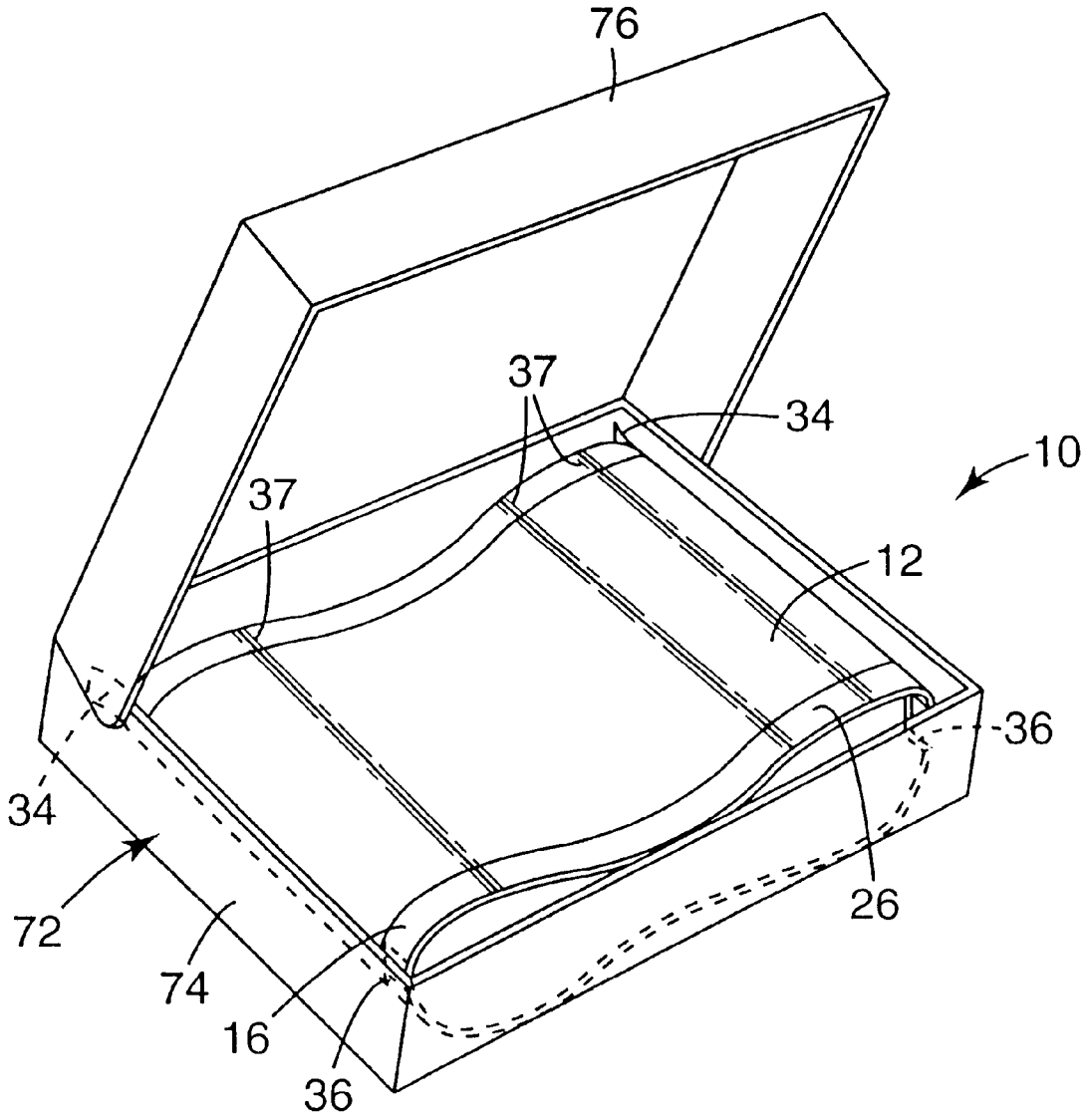
FIG. 3 is a perspective view illustrating a compact configuration of the cartridge device of FIG. 1.
Figure 4:
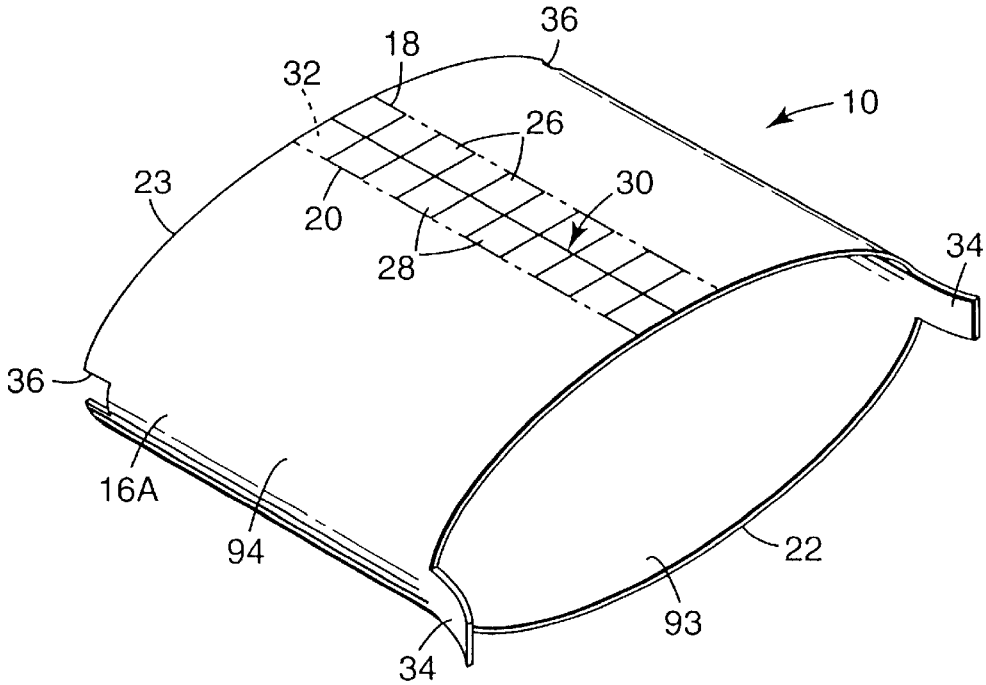
FIG. 4 is a perspective view illustrating an initial, tubular shaped, assembly state of the cartridge device in accordance with a method of manufacturing the cartridge device of FIG. 1.
Figure 5:
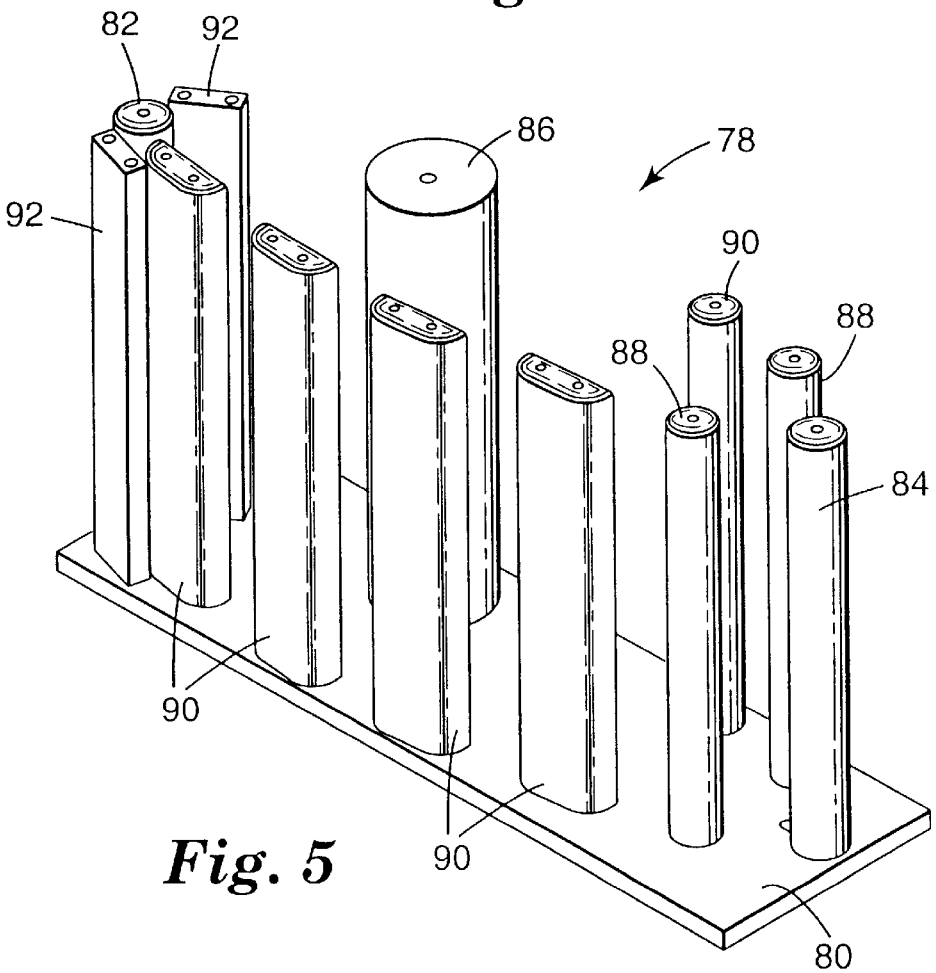
FIG. 5 is a perspective view of a form used in the method of manufacturing the cartridge device shown in FIG. 1.
Figure 6:
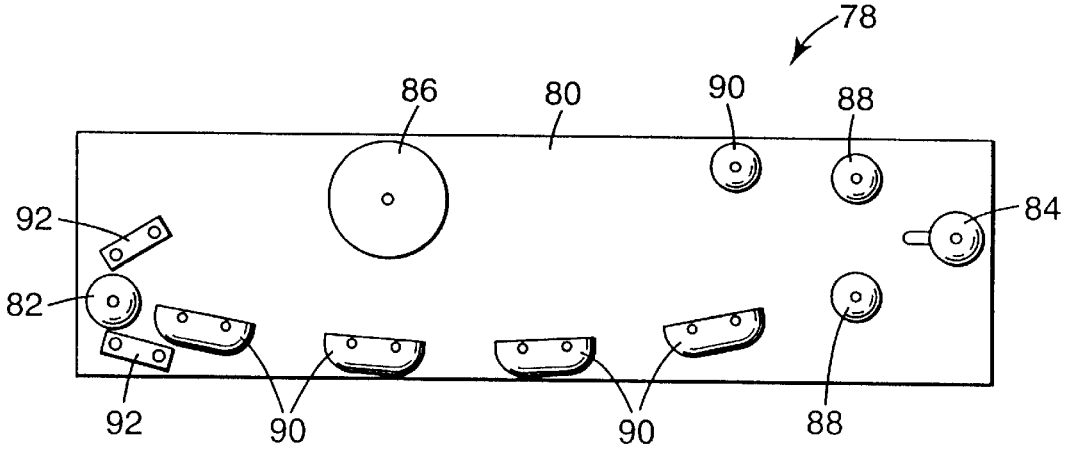
FIG. 6 is an end elevational view of the form shown in FIG. 5.
Figure 8:
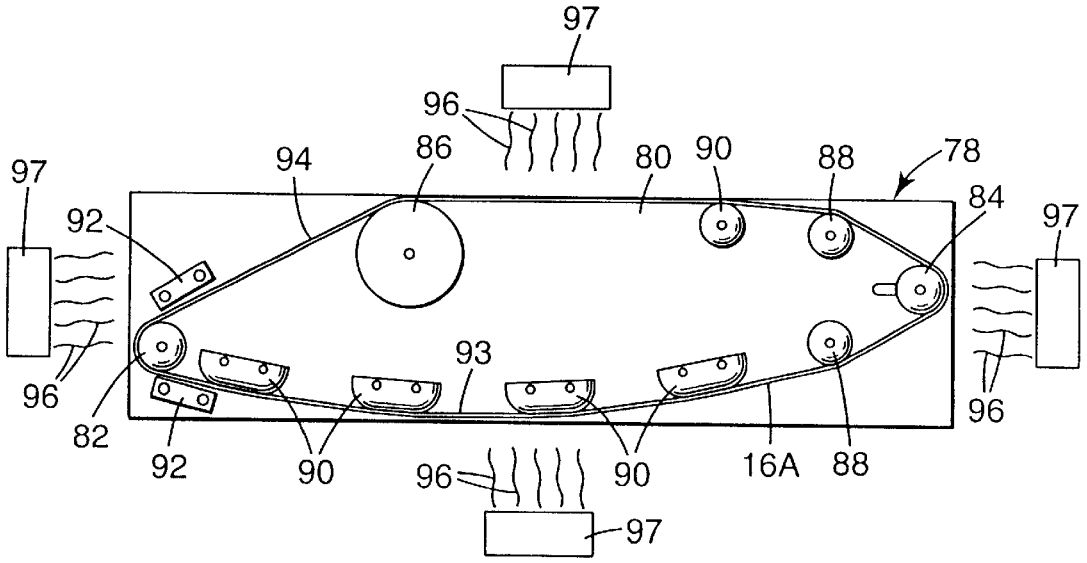
FIG. 8 is an end elevational view of the method of manufacturing of FIG. 7.
Figure 7:
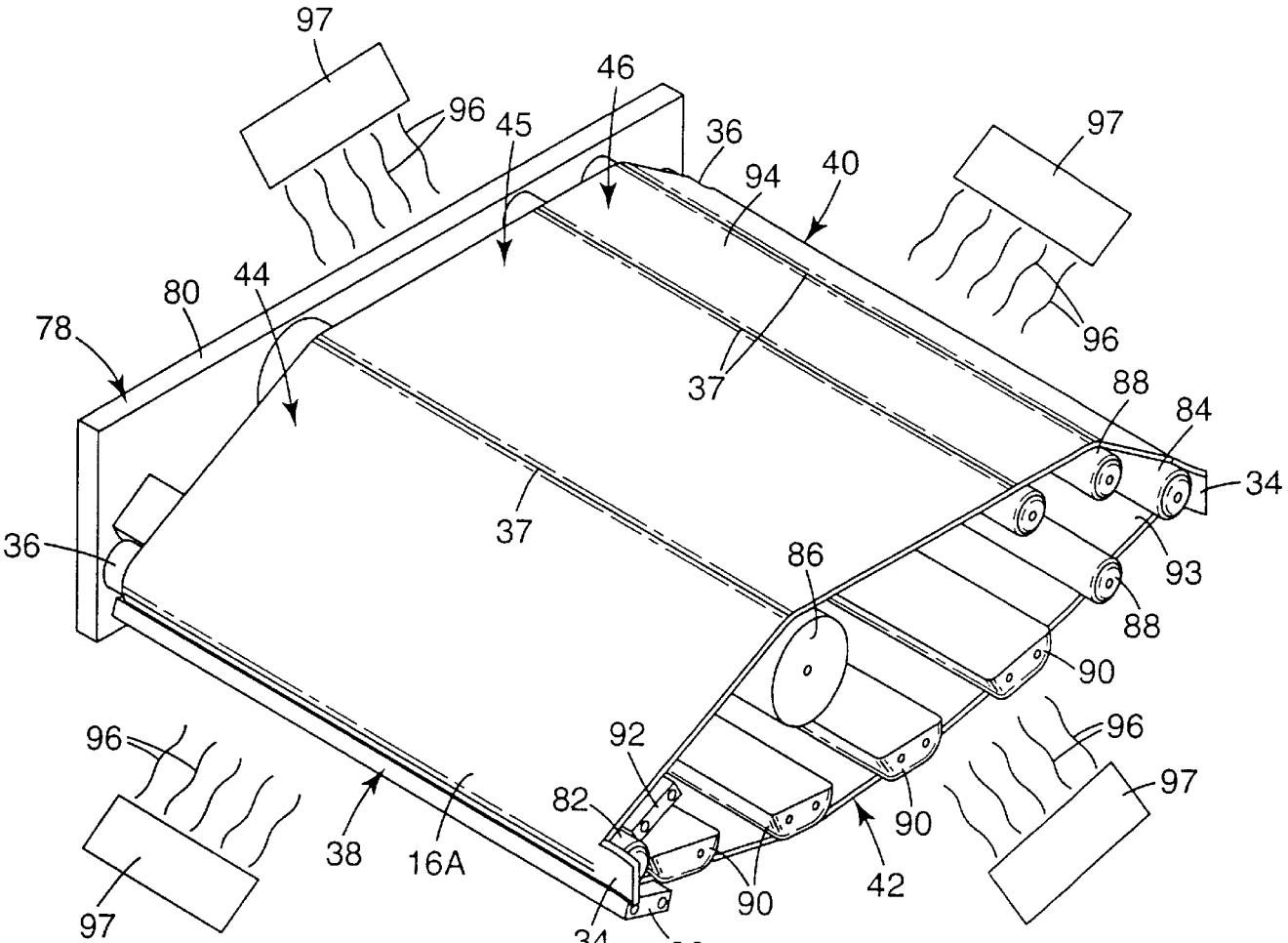
FIG. 7 is a perspective view illustrating the method of manufacturing the cartridge device of FIG. 1 showing the cartridge device being formed to final shape using the form shown in FIGS. 5 and 6.
Figure 9:
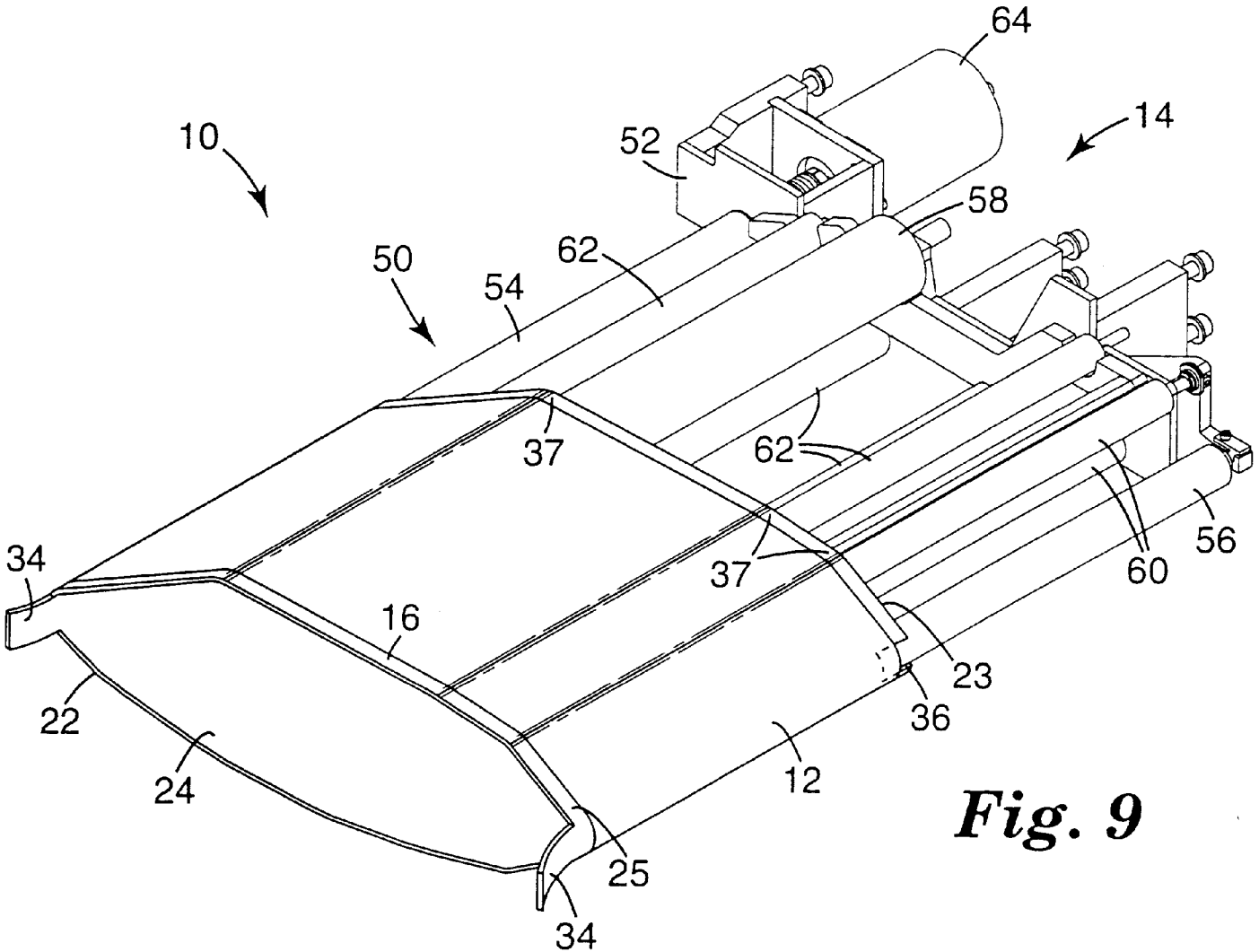
FIG. 9 is a perspective view showing the cartridge device of FIG. 1 with an organic photoreceptor belt thereon being moved onto the support roller system of the electrophotographic printer.
Figure 10:
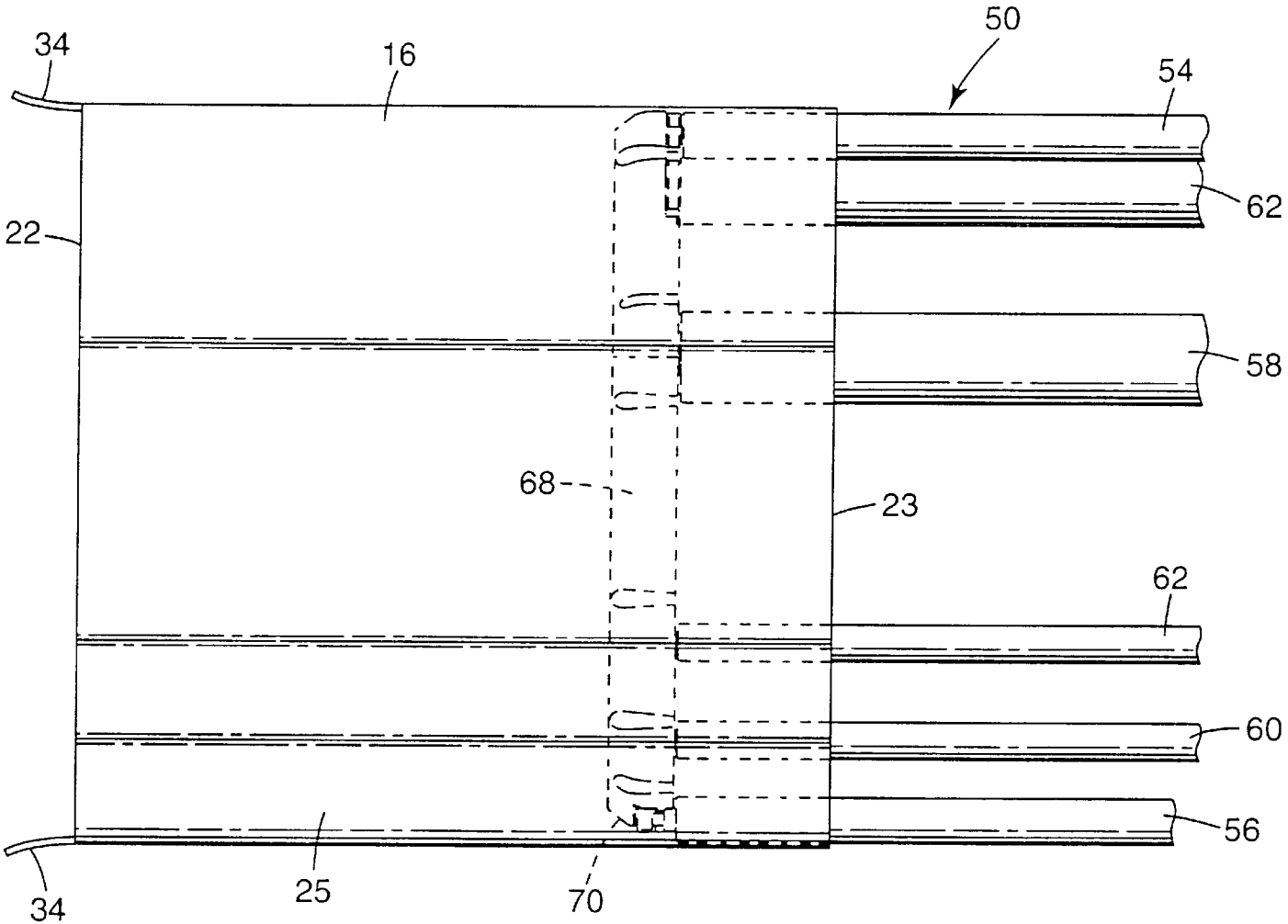
FIG. 10 is a top elevational view illustrating a cone-shaped tip member of the support roller system that facilitates insertion of the cartridge device with an organic photoreceptor belt thereon onto the support roller system of the electrophotographic.

A soft cartridge device 10 for packaging an endless, organic photoreceptor belt 12 (shown in dashed lines in FIG. 1) of an image forming apparatus, such as an electrophotographic printer, in accordance with the present invention is illustrated generally in FIGS. 1–3. One exemplary embodiment of an electrophotographic system is described in detail in a pending patent application filed Sep. 29, 1995, assigned to 3M Company, designated as U.S. patent application Ser. No. 08/537,296, entitled "A Method and Apparatus for Producing a Multi-Color Image in an Electrophotographic System" (Kellie et al.). This pending patent application is incorporated herein by reference.

The organic photoconductor belt assembly is indicated at 14. The soft cartridge device 10 is defined by a closed loop support structure 16 which is manufactured from a sheet of resilient material. The support structure 16 includes first and second marginal edges 18 and 20, respectively, first and second side edges 22 and 23, respectively, and inner and outer surfaces 24 and 25, respectively. The first marginal edge 18 includes a plurality of spaced projections 26 that cooperate with, and are interweaved with, a plurality of spaced projections 28 of the second marginal edge 20 to form a interleaved lap joint 30 that is held together via a suitable adhesive 32. Although an interleaved lap joint 30 is illustrated in FIG. 1, other types of joints such as a butt joint or a simple lap joint may also be used to join the first and second marginal edges 18 and 20. As seen best in FIG. 1, the first side edge 22 of the support structure 16 includes a pair of oppositely positioned, unitary grips or handles 34 that facilitate handling of the cartridge device 10. The second side edge 23 of the support structure 16 includes a pair of oppositely positioned notches or cutouts 36 whose purpose will become clear below. In one preferred embodiment, the resilient material of the closed loop support structure 16 is ABS plastic, and the adhesive 32 is epoxy based.

As seen best in FIG. 1, the support structure 16 of the soft cartridge device 10 has a plurality of widthwise extending prebends 37. These prebends 37 dictate the particular shape of the support structure 16 defined by end regions 38 and 40, curved bottom region 42, and planar regions 44, 45 and 46. This particular shape or configuration is the normal, memory set state of the resilient support structure 16 and is referred to as the belt loading configuration of the soft cartridge device 10. This belt loading configuration of the cartridge device 10 substantially duplicates the configuration of the endless organic photoreceptor belt 12 (see FIG. 2) when the belt 12 is mounted on a support roller system 50 of the organic photoconductor belt assembly 14. As will become clear below, by duplicating the configuration of the organic photoreceptor belt 12 on the support roller system 50 (and therefore the configuration of the support roller system 50 itself), the shape of the belt loading configuration of the soft cartridge device 10 also facilitates loading of the belt 12 onto the support roller system 50 of the organic photoconductor belt assembly 14.

As seen best in FIG. 2, the support roller system 50 of the organic photoconductor belt assembly 14 includes a mounting frame 52 having a drive roller 54, a belt tensioning roller 56, a primary nip roller 58, a pair of stabilizing rollers 60, and a plurality of idler rollers 62 (only some of which can be seen in FIG. 2). The drive roller 54 rotates in a known manner via a drive motor 64 to move the endless organic photoreceptor belt 12 about the support roller system 50. The belt tensioning roller 56 is longitudinally movable, in a known manner, in the direction of double headed arrow 66 to allow de-tensioning and tensioning of the organic photoreceptor belt 12 for organic photoreceptor belt replacement. In FIG. 2, the belt tensioning roller 56 is shown in an organic photoreceptor belt tensioned state in solid lines and in a belt de-tensioned state in dashed lines. As seen best in FIG. 2, the support roller system 50 further includes a tip member 68 having a cone shaped, peripheral edge 70. As will become clear below, the cone shaped, peripheral edge 70 of the tip member 68 facilitates loading of a replacement organic photoreceptor belt 12 onto the support roller system 50 by guiding the soft cartridge device 10 over and onto the rollers 54, 56, 58, 60 and 62.

As seen best in FIG. 3, the resilient support structure 16 of the soft cartridge device 10 also has a compact configuration in addition to the normal, memory set state, belt loading configuration shown in FIG. 1. In both the belt loading configuration and the compact configuration, the cartridge device 10 supports the organic photoreceptor belt 12 under tension. However, in the compact configuration the soft cartridge device 10 requires less volume than the belt loading configuration, and therefore, facilitates shipping and storage of a replacement organic photoreceptor belt 12 supported on the outer surface 25 of the resilient support structure 16. In addition, by minimizing the volume required for the cartridge device 10 and replacement organic photoreceptor belt 12, the cartridge device 10 also minimizes shipping and storage costs. Since the support structure 16 of the soft cartridge device 10 is formed of a resilient material, the resiliency of the material allows the cartridge device 10, with the organic photoreceptor belt 12 thereon, to move between its lesser volume compact configuration and its greater volume belt loading configuration. Hence, the use of the term "soft" to describe the cartridge device 10. In addition, since the belt loading configuration is the normal, memory set state of the support structure 16 of the soft cartridge device 10, an outer force is required to maintain the cartridge device 10 in its compact state. As seen in FIG. 3, this outer force is provided by a container 72 having a lower box portion 74 and a hinged lid 76. It is to be understood that the lid 76 of the container 72 would have to be closed to maintain the soft cartridge device 10 in its compact configuration, and that the lid 76 is shown open only to better illustrate the compact configuration of the cartridge device 10 with the organic photoreceptor belt 12 thereon. When the lid 76 is opened, and the cartridge device 10 is removed from the box portion 74, the soft cartridge device 10 substantially returns to its belt loading configuration and is ready for the belt replacement process.

FIGS. 4–8 illustrate the ease of the method of which the cartridge device 10 can be manufactured in accordance with the present invention. As seen best in FIG. 4, manufacture of the soft cartridge device 10 begins with taking a rectangular sheet of resilient material and removing some of the material from the first and second marginal edges 18 and 20, and the first and second side edges 22 and 23 to form the plurality of spaced projections 26 and 28, the handles 34 and the cutouts 36. This material is removed from the rectangular sheet of material by way of cutting, such as by use of a die cutter. Next, adhesive 32 is applied to the spaced projections 26 and 28, and the first and second marginal edges 18 and 20 are joined by interweaving the spaced projections 26 and 28 to form the interleaved lap joint 30. The result is the tubular shaped, closed loop structure 16A seen in FIG. 4.

To transform the tubular shaped, closed loop structure 16A into the closed loop support structure 16 which defines the soft cartridge 10, the structure 16A is inserted over a form 78 that substantially replicates the configuration of the support roller system 50 of the organic photoconductor belt assembly 14. As seen best in FIGS. 5 and 6, the form 78 includes a main frame 80 supporting a drive roller replica 82, a belt tensioning roller replica 84, a primary nip roller replica 86, a pair of stabilizing roller replicas 88 and a plurality of idler roller replicas 90. In addition, the form 78 includes a pair of confining rods 92. The structure 16A extends about the form 78 with an inner surface 93 of the structure 16A engaging the roller replicas 82, 84, 86, 88 and 90. The confining rods 92 of the form 78 engage an outer surface 94 of the tubular shaped, closed loop structure 16A and help to hold the structure 16A about the form 78. As seen best in FIGS. 7 and 8, with the closed loop structure 16A in place about the form 78, heat 96 from heaters 97 is applied to the closed loop structure 16A for a set amount of time. This causes the closed loop structure 16A to take a normal, memory set shape having prebends 37 that duplicates the shape of the form 78 (i.e., also known as the belt loading configuration of the soft cartridge device 10), thereby transforming the structure 16A into the support structure 16 defining the soft cartridge device 10. In one preferred embodiment, the closed loop structure is heated to a temperature of substantially 95° C. for substantially ten minutes. The support structure 16 is then allowed to cool to room temperature on the form. Once cooled, the now formed soft cartridge device 10 is removed from the form 78 and a replacement organic photoreceptor belt 12 is slid onto the outer surface 25 of the cartridge 10 completing the method of manufacturing the cartridge device 10. Placing soft cartridge 10 with the replacement organic photoreceptor belt 12 thereon into the container 72 completes the packaging process.

FIGS. 9–12 illustrate the operation of loading a replacement organic photoreceptor belt 12 onto the support roller system 50 of an organic photoconductor belt assembly 14 using the soft cartridge device 10 in accordance with the present invention. To begin, the belt tensioning roller 56 is moved by a user, such as an office worker, to its de-tensioned state. The used organic photoreceptor belt is then simply slid off of the support roller system 50 and discarded. Then, with the belt tensioning roller still in its de-tensioned state, the soft cartridge device 10, with the replacement organic photoreceptor belt 12 supported thereon, is removed from the container 72 which allows the cartridge device 10 to expand from its compact configuration to its belt loading configuration. As seen best in FIG. 9, with the cartridge device 10 in its belt loading configuration, the user aligns the cartridge device with the support roller system 50 such that the shape of the cartridge device 10 matches that shape of the roller system 50 (i.e., the tip member 68). The soft cartridge device 10, with the endless, replacement organic photoreceptor belt 12 supported thereon, is then slid, by the user, fully onto the support roller system 50 (see FIG. 11) such that the inner surface 24 of the device 10 engages the rollers 54, 56, 58 60 and 62. As seen best in FIG. 10, the cone shaped peripheral edge 70 of the tip member 68 facilitates loading of the cartridge device 10 by guiding the cartridge device 10 onto and over the support roller system 50 of the organic photoconductor belt assembly 14.

Figure 11:
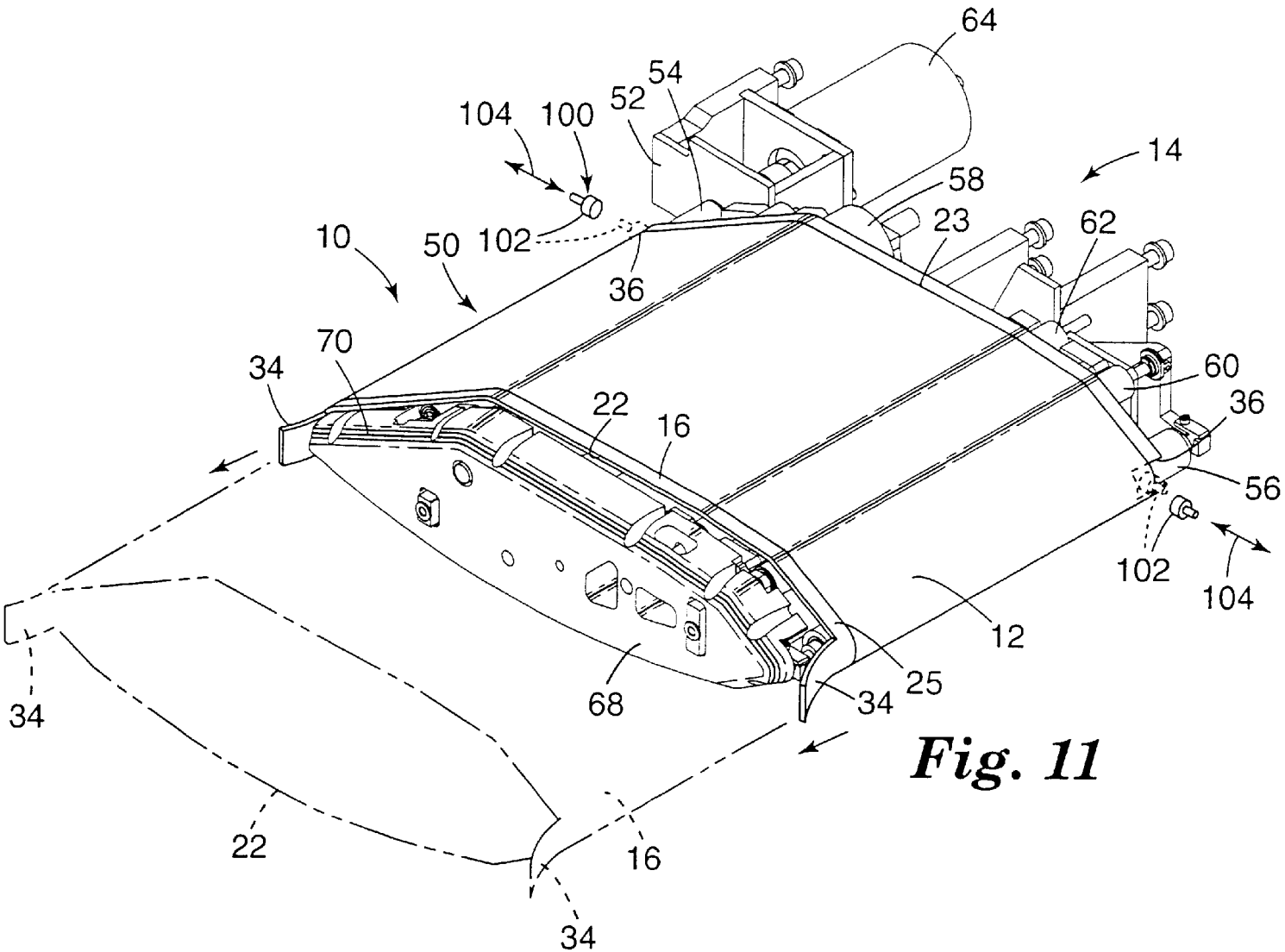
FIG. 11 is a perspective view similar to FIG. 9 showing the cartridge device with organic photoreceptor belt thereon fully inserted over the support roller system of the electrophotographic printer.
Figure 12:
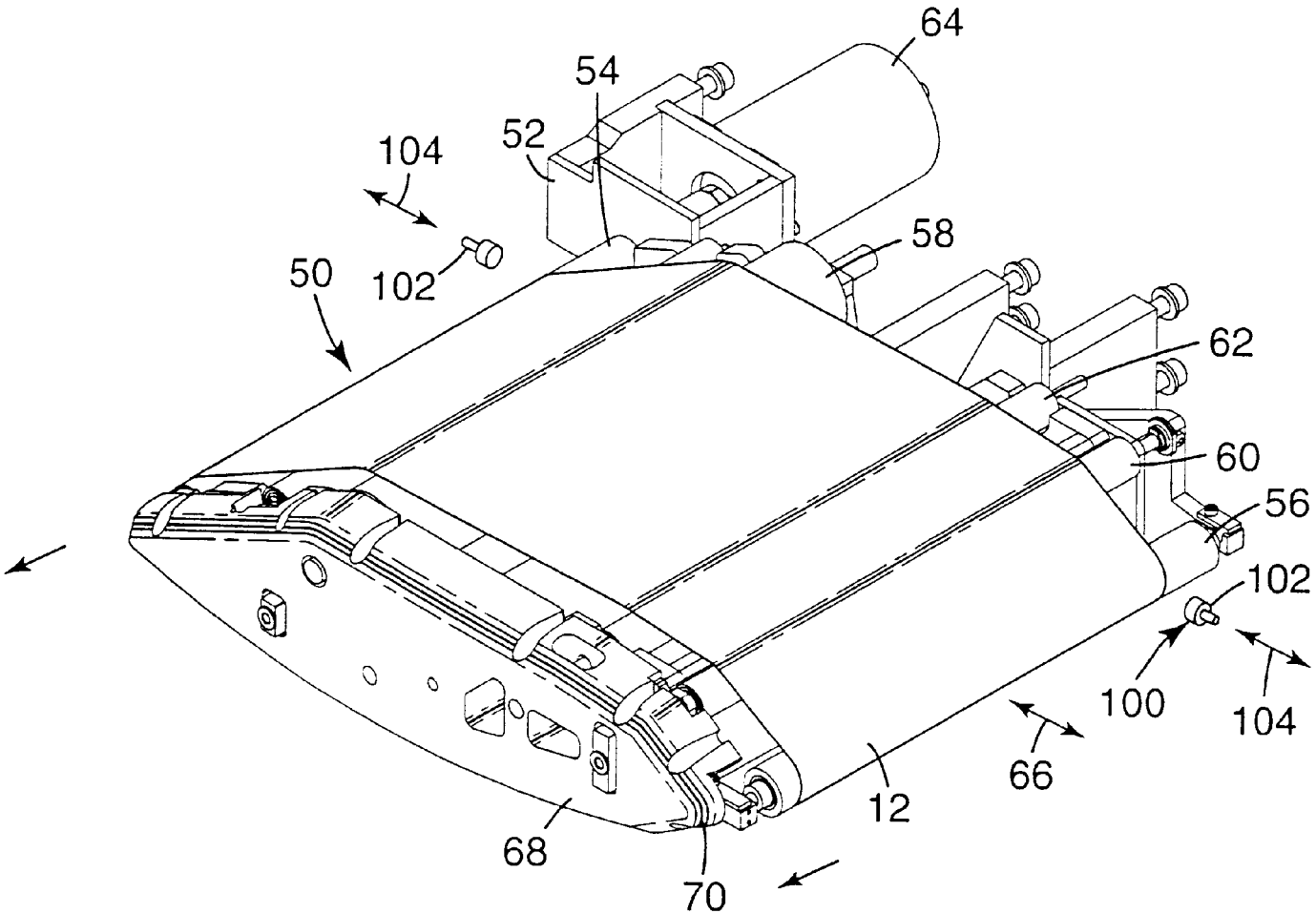
FIG. 12 is a perspective view similar to FIG. 9 of the support roller system with the organic photoreceptor belt thereon and with the cartridge device removed therefrom.

As seen best in FIG. 11, the width of the soft cartridge device 10 is greater than the width of the organic photoreceptor belt, hence, the user need never touch the replacement organic photoreceptor belt 12 during the replacement process. However, the organic photoreceptor belt 12 does extend over the pair of cutouts 36 at the second side edge 23. This allows a hold down mechanism 100 of the organic photoconductor belt assembly 14 to move into engagement with the organic photoreceptor belt 12 through the cutouts 36 to hold the replacement organic photoreceptor belt 12 against movement relative to the support roller system 50. Hold down mechanism 100 includes a pair of mushroom shaped holders 102 that are longitudinally movable, as represented by double headed arrows 104, between a disengaged position (solid lines) and an engaged position (dashed lines). With the soft cartridge device 10 fully on the support roller system 50, the user causes the holders 102 to move inward to engage the organic photoreceptor belt 12 at the cutouts 36. The holders 102, in their engaged positions, hold the belt 12 against the drive roller 54 on one side of the roller system 50 and against the belt tensioning roller 56 on the other side of the roller system 50. This fixes the endless, replacement organic photoreceptor belt 12 in place and allows the user, by grasping the handles 34, to slide the cartridge device 10 out from between the organic photoreceptor belt 12 and the roller system 50. As seen best in FIG. 12, this action removes the soft cartridge device 10 from the organic photoconductor belt assembly 14 leaving the replacement organic photoreceptor belt 12 in place on the support roller system 50. The relatively unbulky soft cartridge device 10 is then discarded. The holders 102 are then moved by the user out of engagement with the replacement organic photoreceptor belt 12 (i.e., to their disengaged position), and the belt tensioning roller 56 is moved to its tensioned state which tensions the replacement organic photoreceptor belt 12 and completes the replacement process.

Figure 13:
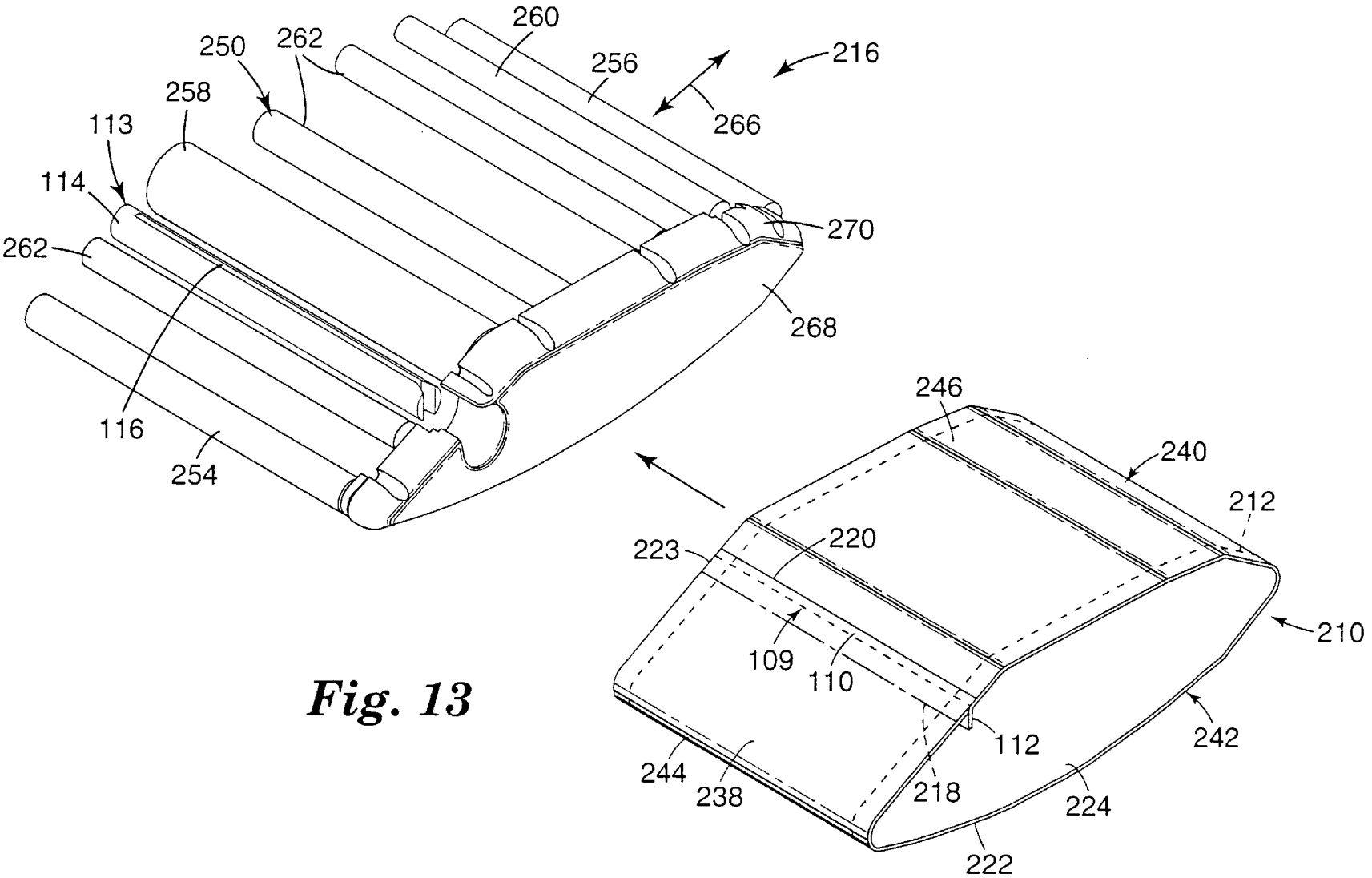
FIG. 13 is a perspective view illustrating an alternative embodiment of the cartridge device in accordance with the present invention.
Figure 14:
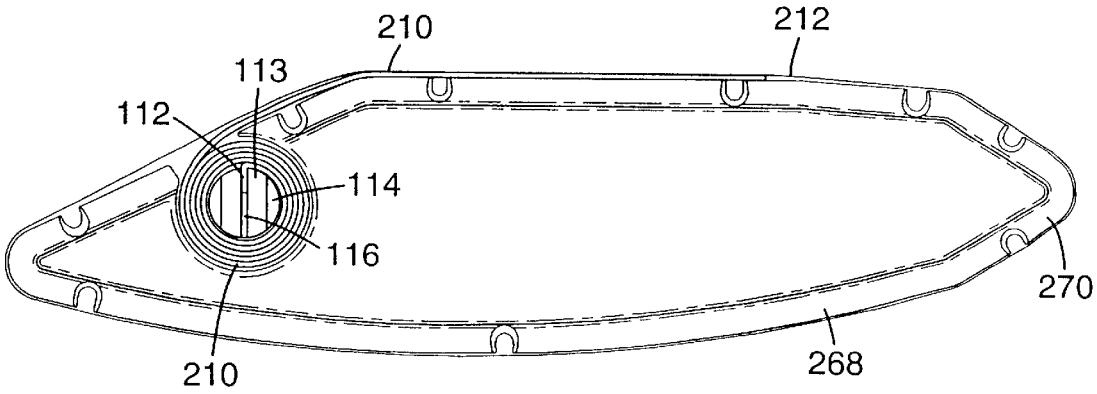
FIG. 14 is an end elevational view illustrating the alternative embodiment of the cartridge device being removed from the organic photoreceptor belt.
Figure 15:
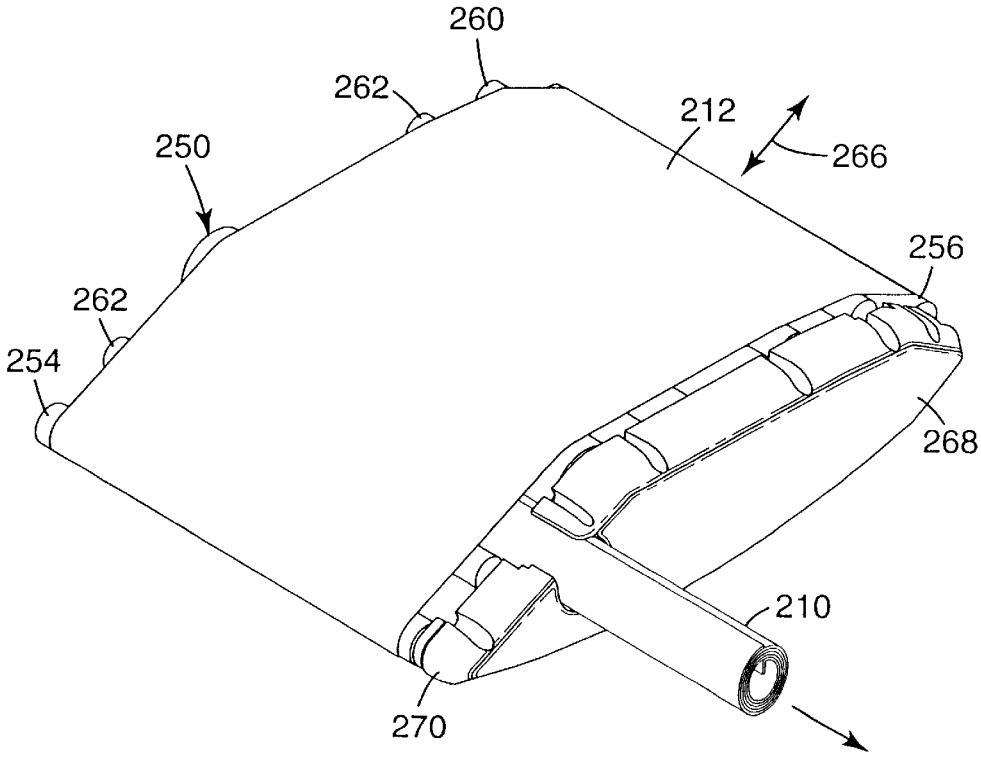
FIG. 15 is a perspective view of the support roller system with the organic photoreceptor belt thereon and of the alternative embodiment of the cartridge device being removed from the support roller system.

FIGS. 13–15 illustrate an alternative soft cartridge device embodiment 210. Like parts are labeled with like numerals except for the addition of the prescript 2. In the alternative soft cartridge device 210, the handles 34 and cutouts 36 have been eliminated from the support structure 216. In addition, in the alternative embodiment of the soft cartridge device 210, the first and second marginal edges 218 and 220 are joined at a simple lap joint 109 held together via a readily releasable adhesive 110, such that the first marginal edge 218 defines a removal flap 112. Further, the organic photoconductor belt assembly 214 includes a cartridge device removal mechanism 113 that includes a take-up roller 114. In operation, as seen best in FIGS. 13 and 14, upon insertion of the soft cartridge device 210, with the replacement organic photoreceptor belt 212 supported thereon, onto the roller system 250, the flap 112 slides into a groove 116 of the take-up roller 114. Once the soft cartridge device 210 is fully on the support roller system 250, the user rotates the take-up roller 114 which causes the soft cartridge device 210 to separate along its marginal edges 218 and 220 due to the use of the readily releasable adhesive 110.

As seen best in FIG. 14 further rotation of the take-up roller 114 causes the cartridge device 210 to be completely removed from between the replacement organic photoreceptor belt 212 and the support roller system 250 and to be wound onto the take-up roller 114. This leaves only the replacement organic photoreceptor belt 212 on the roller system 250 of the organic photoconductor belt assembly 214. As seen best in FIG. 15, once the soft cartridge device 210 is fully wound onto the take-up roller 114, the user merely slides the cartridge device 210 off of the take-up roller 114 and discards the device 10. Tensioning of the replacement organic photoreceptor belt 212 completes the organic photoreceptor belt replacement process.

Similarly, roller 114 may be employed for removal of organic photoreceptor belt 212. In one embodiment, the organic photoreceptor belt 212 is cut in the cross web direction. The cut edge of organic photoreceptor belt 214 is inserted into groove 116, and roller 114 is operably rotated to take up the organic photoreceptor belt 214.

The cartridge device 10, 210 of the present invention, whether in the belt loading configuration or the compact configuration, holds the organic photoreceptor belt 12, 212 in a tensioned state that helps to protect the belt 12, 212 from damaging bends and creases that would adversely affect the image reproduction quality of the replacement organic photoreceptor belt 12, 212. In addition, the cartridge device 10, 210 protects the fragile organic photoreceptor coating of the belt 12, 212 from other damage, in the form of finger prints, scratches and/or abrasions, caused by organic photoreceptor belt mishandling by office personnel during the replacement process. The cartridge device 10, 210 provides protection during the organic photoreceptor belt replacement process since office personnel need only touch the cartridge device 10, 210 during the replacement process and not the organic photoreceptor belt 12, 212 itself. In addition to providing organic photoreceptor belt protection, the cartridge device 10, 210 of the present invention minimizes, when compared to prior art cartridge designs, the amount of consumables that must be disposed of as a result of the organic photoreceptor belt replacement process. Moreover, the cartridge device 10, 210 of the present invention in its compact configuration facilitates storage and shipping of replacement organic photoreceptor belts 12, 212 since the compact configuration requires less volume than the belt loading configuration. By minimizing the shipping volume and weight of the organic photoreceptor belt replacement, the cartridge device 10, 210 of the present invention also minimizes shipping costs and office supply shelf space requirements. Lastly, this soft cartridge device 10, 210 also provides these features while being relatively easy and inexpensive to manufacture.

Although the present invention has been described with reference to preferred embodiments, workers skilled in the art will recognize that changes may be made in form and detail without departing from the spirit and scope of the invention.

We claim:

1. A cartridge device for packaging an endless photoreceptor belt of an image forming apparatus having support rollers for supporting the endless photoreceptor belt, the cartridge device comprising:

a structure for supporting the endless photoreceptor belt, the support structure having a belt loading configuration, that supports the endless belt such that the endless belt substantially duplicates a configuration of the endless belt when the belt is mounted onto the support rollers of the image forming apparatus, so as to facilitate loading of the belt onto the support rollers, and a compact configuration, that supports the endless belt such that the endless belt does not substantially duplicate the configuration of the endless belt when the belt is mounted onto the support rollers of the imaging forming apparatus, the compact configuration of the support structure requiring less volume than the belt loading configuration.

2. The cartridge device of claim 1 wherein the support structure is formed from a resilient material, and wherein the resiliency of the material allows the support structure with the photoreceptor belt supported thereon to move between its lesser volume compact configuration and its greater volume belt loading configuration.

3. The cartridge device of claim 2 wherein one of the compact configuration and the belt loading configuration is a normal memory set state of the support structure and the other one of the compact configuration and belt loading configuration is held in that configuration by an outer force.

4. The cartridge device of claim 3 wherein the normal memory set state of the support structure is the belt loading configuration.

5. The cartridge device of claim 4 wherein the lesser volume compact configuration of the support structure with the photoreceptor belt supported thereon facilitates storage and shipping of the belt, and wherein the outer force that maintains the support structure in its compact configuration is provided by a closed container that houses the support structure during shipping and storage.

6. The cartridge device of claim 1 wherein the support structure has a closed loop shape and engages an inner surface of the endless photoreceptor belt to support the belt under tension.

7. The cartridge device of claim 6 wherein the support structure is defined by a planar sheet of resilient material having first and second marginal edges that are joined to form the closed loop shaped support structure.

8. The cartridge device of claim 7 wherein the first and second marginal edges are joined via an interleaved lap joint held together by adhesive.

9. A cartridge device for packaging an endless photoreceptor belt of an image forming apparatus having support rollers for supporting the endless photoreceptor belt, the cartridge device comprising:

a structure for supporting the endless photoreceptor belt, the support structure having a closed loop shape and engaging an inner surface of the endless photoreceptor belt to support the belt under tension, the support structure having a belt loading configuration, that substantially duplicates a configuration of the endless belt when the belt is mounted onto the support rollers of the image forming apparatus, so as to facilitate loading of the belt onto the support rollers, and a compact configuration, that requires less volume than the belt loading configuration; wherein the endless photoreceptor belt is loaded onto the support rollers of the image forming apparatus by inserting the closed loop support structure with the belt supported thereon over the support rollers, and wherein the support structure defining the cartridge device includes removal mechanism to permit photoreceptor belt hold down mechanism, of the image forming apparatus, to hold the belt against movement relative to the support rollers, so that the closed loop support structure can be removed from the support rollers and the belt, leaving only the belt on the support rollers of the image forming apparatus.

10. The cartridge device of claim 9 wherein the removal mechanism of the closed loop support structure is defined by a plurality of cutout regions that allow the photoreceptor belt hold down mechanism to hold the photoreceptor belt to the support rollers through the cutout regions.

11. The cartridge device of claim 10 wherein the plurality of cutout regions includes a pair of cutouts oppositely positioned along a side edge of the closed loop support structure.

12. The cartridge device of claim 9, further including mechanism on the support structure to allow a user to grip the support structure to facilitate the removal of the closed loop support structure from the support rollers and from underneath the photoreceptor belt.

13. The cartridge device of claim 12 wherein the grip mechanism includes a pair of oppositely positioned handles that extend outwardly from a side edge of the closed loop support structure.

14. A cartridge device for packaging an endless photoreceptor belt of an image forming apparatus having support rollers for supporting the endless photoreceptor belt, the cartridge device comprising:

a structure for supporting the endless photoreceptor belt, the support structure being defined by a planar sheet of resilient material having first and second marginal edges that are joined to form a closed loop shape for engaging an inner surface of the endless photoreceptor belt to support the belt under tension, the support structure having a belt loading configuration, that substantially duplicates a configuration of the endless belt when the belt is mounted onto the support rollers of the image forming apparatus, so as to facilitate loading of the belt onto the support rollers, and a compact configuration, that requires less volume than the belt loading configuration; wherein the first and second marginal edges of the closed loop support structure are joined via a releasable adhesive, and wherein the endless photoreceptor belt is loaded onto the support rollers of the image forming apparatus by inserting the closed loop support structure with the belt supported thereon over the support rollers.

15. The cartridge device of claim 14 wherein the first marginal edge of the support structure defining the cartridge device includes a flap to permit cartridge device removal mechanism, of the image forming apparatus, to grasp the flap and cause separation of the first and second marginal edges of the support structure along the releasable adhesive, so that the closed loop support structure can be removed from the support rollers and the belt, leaving only the belt on the support rollers of the image forming apparatus.

16. A method of manufacturing a closed loop cartridge device for packaging an endless photoreceptor belt of an image forming apparatus having support rollers for supporting the endless photoreceptor belt, the method comprising the steps of:

providing a sheet of resilient material having first and second marginal edges and first and second side edges;

forming, from the sheet of resilient material, a tubular shaped, closed loop structure;

providing a form having a configuration that substantially duplicates a configuration of the endless photoreceptor belt when the endless photoreceptor belt is mounted onto the support rollers of the image forming apparatus;

positioning the tubular shaped, closed loop structure over the form;

heating the closed loop structure on the form for a set amount of time, such that the closed loop structure defines a formed closed loop cartridge device, the shape of which, substantially replicates the configuration of the form, and thereby duplicates the configuration of an endless photoreceptor belt when the endless photoreceptor belt is mounted onto the support rollers of an image forming apparatus; and removing the formed closed loop cartridge device from the form.

17. The method of claim 16, further including the step of:

positioning an endless photoreceptor belt on an outer surface of the closed loop cartridge device.

18. The method of claim 16 wherein the step of forming the tubular shaped, closed loop support structure includes the steps of:

removing material from the first side edge of the sheet of resilient material to form a pair of oppositely positioned cutouts;

removing material from the second side edge of the sheet of resilient material to form a pair of oppositely positioned handles; and joining the first marginal edge of the support structure to the second marginal edge of the support structure, thereby defining the tubular shaped, closed loop structure.

19. The method of claim 18 wherein the step of applying heat to the closed loop support structure on the form includes the step of:

cooling the closed loop cartridge device to room temperature.

20. A method of loading an endless photoreceptor belt onto support rollers of an image forming apparatus, the method comprising the steps of:

providing a cartridge device defined by a closed loop support structure having an endless photoreceptor belt therearound, the support structure with the belt thereon having a configuration that substantially duplicates a configuration of support rollers of an image forming apparatus;

aligning the closed loop support structure with the support rollers of the image forming apparatus such that the configuration of the support structure matches the configuration of the support rollers;

moving the closed loop support structure onto the support rollers such that the support structure, with the endless photoreceptor belt supported thereon, is fully on the support rollers;

holding the belt against movement relative to the support rollers using a photoreceptor belt hold down mechanism of the image forming apparatus, so that the support structure, defining the cartridge device, can be removed from the support rollers without altering the position of the belt;

grasping grip mechanism on the support structure to facilitate removal of the support structure from between the belt and the support rollers;

removing the closed loop support structure from between the endless photoreceptor belt and the support rollers leaving only the belt on the support rollers of the image forming apparatus; and tensioning the endless photoreceptor belt to make the belt ready for image reproduction.

21. A method of loading an endless photoreceptor belt onto support rollers of an image forming apparatus, the method comprising the steps of:

providing a cartridge device defined by a closed loop support structure having an endless photoreceptor belt therearound, the support structure with the belt thereon having a configuration that substantially duplicates a configuration of support rollers of an image forming apparatus;

aligning the closed loop support structure with the support rollers of the image forming apparatus such that the configuration of the support structure matches the configuration of the support rollers;

moving the closed loop support structure onto the support rollers such that the support structure, with the endless photoreceptor belt supported thereon, is fully on the support rollers;

actuating cartridge device removal mechanism of the image forming apparatus which is engaged with a removal flap on the support structure and causes the support structure to separate along its marginal edges and removes the support structure, defining the cartridge device, from the support rollers without altering the position of the belt;

removing the support structure from the cartridge device removal mechanism leaving only the belt on the support rollers of the image forming apparatus; and tensioning the endless photoreceptor belt to make the belt ready for image reproduction.

* * * * *